United States Patent [19]

Middlekauff

[11] Patent Number: 4,545,748

[45] Date of Patent: Oct. 8, 1985

[54] COMPACT HIGH TORQUE HYDRAULIC MOTORS

[75] Inventor: Carle A. Middlekauff, Cumberland, Me.

[73] Assignee: Parker-Hannifin Corporation, Cleveland, Ohio

[21] Appl. No.: 633,270

[22] Filed: Jul. 23, 1984

[51] Int. Cl.[4] ..... F01C 1/113

[52] U.S. Cl. ..... 418/61 B

[58] Field of Search ..... 418/61 B

[56] References Cited

U.S. PATENT DOCUMENTS

| | | | |
|---|---|---|---|
| 3,289,542 | 12/1966 | Fikse | 418/61 B |
| 3,289,601 | 12/1966 | Compton | 418/61 B |
| 3,364,907 | 1/1968 | Jearson | 418/61 B |
| 3,453,966 | 7/1969 | Eddy | 418/61 B |
| 3,531,225 | 9/1970 | Woodling | 418/61 B |
| 3,561,893 | 2/1971 | Baatrup | 418/61 B |
| 3,592,233 | 7/1971 | Woodling | 418/61 B |
| 3,623,829 | 11/1971 | Shaw et al. | 418/171 |
| 3,887,308 | 6/1975 | Liebert | 418/61 B |
| 4,139,335 | 2/1979 | Wüsthof et al. | 418/61 B |
| 4,426,199 | 1/1984 | Wüsthof et al. | 418/61 B |

*Primary Examiner*—William L. Freeh
*Assistant Examiner*—Paul F. Neils
*Attorney, Agent, or Firm*—Hamilton, Brook, Smith & Reynolds

[57] ABSTRACT

A rotary fluid displacing pump or motor in which the inner gear orbits about a fixed motor shaft axis within an outer gear and the inwardly extending gear teeth of the outer member have non-sealing portions not in contact with corresponding portions on the outwardly extending teeth of the inner gear. Variable volume chambers formed between the gear teeth are fluidly coupled to inlet and outlet fluid passageways at appropriately timed intervals by a rotary disc having radially spaced ports which rotate past inlet and outlet ports on a fixed commutator. The rotary disc abuts a planar face of the orbiting inner gear and rotates about the fixed central axis.

10 Claims, 6 Drawing Figures

COMPACT HIGH TORQUE HYDRAULIC MOTORS

DESCRIPTION

1. Technical Field

This invention relates to compact hydraulic high torque motors.

2. Background Art

The commonly used form of hydraulic motor consists of internal gear or gerotor sets in which inner and outer gear members have radially projecting and opposing teeth that engage with each other to form expanding and contacting chambers. Pressurized fluid circulated through the chambers produces shaft rotation. Conversely, in a pump, shaft rotation is used to produce fluid pressure. Thus, these gear sets can be used as either hydraulic motors or hydraulic pumps.

Such gear sets may be of the externally generated rotor-type (EGR) as shown in Woodling, U.S. Pat. No. 3,623,829. In the EGR gear sets, the inner gear normally is provided with an even number of teeth, one less than the number of internal teeth on the outer gear. The teeth on the inner member are on the external periphery of the member and extend radially away from the center of the inner member. As described in Woodling, U.S. Pat. No. 3,531,225, the inner gear which is usually the rotor of an EGR gear set has a moveable axis which moves in an orbital path about the fixed axis of the outer gear or stator. The orbital path of the moveable axis is a circle with its center coinciding with the fixed axis of the stator. The diameter of this circle is equal to the difference in the radial dimension between the crest contour and the root contour of a stator tooth.

In an EGR gear set, the contour of the external teeth of the inner gear is generated so as to maintain a conjugate relationship with the lobes of the internal teeth of the outer gear during the relative movement between the two. The teeth on the outer member extend radially inwardly and are disposed on the internal periphery of the outer member and hence are called internal teeth.

In 1971, U.S. Pat. No. 3,623,829 issued to Shaw and Gervais describing a new form of gear set of the Internally Generated Gear (IGG) type. By way of contrast with the EGR gear set, the inner gear in the IGG-type gear set normally has an odd number of external teeth, one less than the number of internal teeth on the outer gear. More importantly, the contour of the internal teeth on the outer gear is generated so as to maintain a conjugate relationship with the lobes of the external teeth on the inner gear during relative movement between the two. In other words, the internal peripheral profile (contour) of the outer member is a smooth, continuous curve.

In an EGR-type gear set, all points on the generated contour of the inner gear are "active", i.e., required to form a fluid seal, at least once per revolution of the gear set. On the other hand, the "active" points in the IGG-type gear set occur on the outer gear and non-active zones are present on the inner gear contour between the tips of the inner gear thus providing a relatively wide zone for input and output fluid porting.

Various improvements have evolved in which the advantages of an IGG gear set have been utilized, as outlined below.

One development is described in Wusthof, U.S. Pat. No. 4,139,335. Wusthof '335 utilizes a universal joint ("dog-bone") shaft 12 to convert the orbital rotation of the inner gear ("rotor") of an IGG gear set to a circular motion at an output machine shaft. Porting is accomplished by means of a control disk which rotationally orbits in unison with the inner gear. The disk acts as a rotary valve in conjunction with a fixed control plate mounted flush against one face of the IGG gear set. The relative movement of ports on the disk with respect to ports on the fixed plate permits appropriately timed entry and exit of fluid into the chambers formed between the IGG gears.

The rotary control disk 18 in Wusthof '335 is constrained in an orbiting motion. Thus, at certain periods of time during the orbiting motion, the port openings in the disk are slowed down to zero velocity with respect to the control plate. Hence, fluid cannot enter or exit sufficiently fast to accommodate substantial flow rates.

To avoid the above mentioned deficiencies in Wusthof '335, an orbiting outer member IGG system was developed, as shown in co-pending patent application, Ser. No. 473,367 filed Mar. 8, 1983. In this orbiting outer member IGG system, a rotating valve plate 48 is mounted flush against a face of the IGG gear set and is rotated about the central axis of the output shaft. Ports in the rotating valve plate cooperate with ports in a fixed commutator to provide appropriately timed input and output flow to and from chambers in the gear set.

The IGG system described in Ser. No. 473,367 is adequate for the purposes intended. It solved the problem of insufficient speed of relative movement between ports on the rotary valve plate with respect to ports on the commutator, since now the rotary valve plate moves circularly about a central axis rather than orbiting as in Wusthof '335.

On the other hand, the requirement of an orbiting outer member introduced added weight to the IGG system. The diameter of the housing must be adequate to accommodate this orbital motion of the outer member. The weight of an EGR or IGG motor is directly related to the cost to manufacture. Therefore, to keep the cost of a motor low, it is necessary to reduce the weight.

DISCLOSURE OF THE INVENTION

This invention comprises a low cost, low weight, IGG-type hydraulic motor in which the inner member of the IGG gear set is caused to rotationally orbit with respect to the outer member. That is to say, the inner member orbits about the fixed central axis of a non-rotating outer member and rotates about its own movable axis which is displaced with respect to the fixed axis. A rotary valve plate is mounted adjacent and flush against a face of the IGG gear set and caused to rotate about the fixed axis of the output shaft of the rotor. Ports on the valve plate cooperate with ports on a fixed commutator to permit suitably timed input and output flow to and from chambers formed between the IGG gears, thereby to cause the output shaft to rotate in response to fluid flow.

It is estimated that this device can be produced in a highly efficient motor using gerolers with a total weight of about 9 pounds, as compared to a similar commercial EGR non-geroler device which weighs 12 pounds and is less efficient. Also, as compared to non-dog-bone type IGG gear sets of the type shown in co-pending patent application Ser. No. 473,367 filed 3/8/83, the weight is reduced from 15 pounds to about 9 pounds. Part of the weight reduction is achieved by the removal of the requirement of a fixed sealing member adjacent the face of the inner member. In an IGG gear set, as mentioned earlier, portions of the external gear surface are inactive and do not have to be sealed. By eliminating this fixed sealing member adjacent the face, the overall length can be reduced, thus achieving substantial weight savings.

BEST MODE OF CARRYING OUT THE INVENTION

Figure 1:
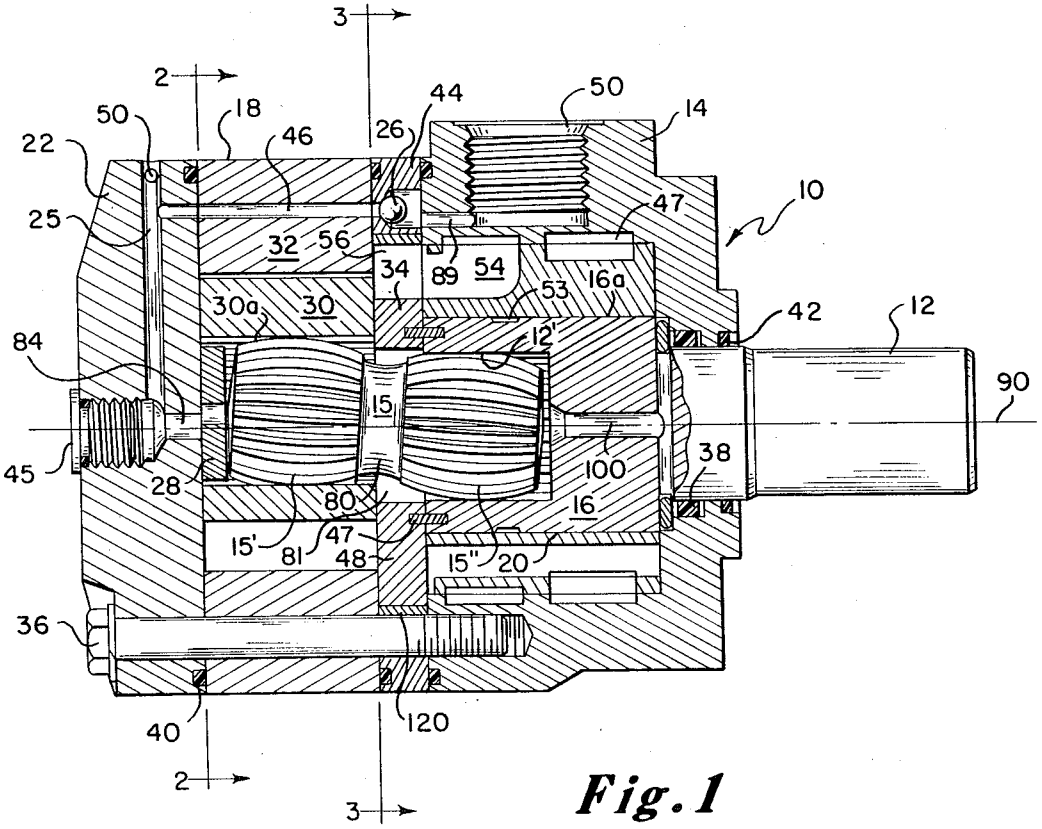
FIG. 1 is a longitudinal cross-section of an embodiment of the invention.

The invention will now be described in detail in connection with the drawings. As shown in FIG. 1, the motor, shown generally at 10, has a housing made up of four casings or sections 14, 44, 18 and 22, in which two shafts 15 and 12 rotate. The output shaft casing 14 incorporates a pressurized sleeve bearing (not shown) which rotationally supports output shaft 12. The bearing may be a DU* bearing which is a type of sleeve bearing made by Garlock Bearings, Inc. It is a steel backed porous Teflon TM -impregnated bronze bearing. At low speeds and high torque, the bearing heats up and the Teflon oozes through the bronze pores and lubricates the bearings surfaces. At high speeds, the bearings is lubricated by hydraulic fluid which is pressurized at high speeds and allowed to penetrate into the bearing surfaces. As shown in FIG. 1, the bearing surface 20 is divided into two sections by inner circumferential groove 53. Shaft 12 extends through a bore 16*a* in a fixed commutator 16 within the casing 14.

*DU is a registered trademark of the Glacier Metal Company, Ltd.

An IGG gear set, comprising inner member 30 and outer member 32, is provided within a gear set housing 18. A valve plate 48 is housed in casing 44 and is affixed to the shaft 12 by pins 47 for rotation within bearing surface 120 in unison with output shaft 12. The outer member or gear 32 is restricted from rotation by housing 18.

Shaft 15 is a universal or dog-bone-type shaft which has external curved splines 15' at the end complementary to internal curved splines on a central passageway or bore 30*a* through inner member 30. A location spacer 28 within bore 30*a* axially positions dog-bone shaft 15 within the bore.

A reduced diameter section 80 is provided on shaft 15 between the two splined sections enabling shaft 15 to freely extend through an inner bore 81 on valve plate 48 without contacting plate 48.

External curved splines 15'', at the remaining end of shaft 15, mate with corresponding curved splines on the inner surface 12' of the bore provided at one end of shaft 12. The universal shaft 15 is thus turnably and tiltably coupled at one end with the gear member 30 and at the remaining end with the output shaft 12. Thus, the rotational orbital motion of member 30 with respect to the fixed central axis 90 is converted by universal shaft 15 to circular rotational motion of shaft 12 about its central axis 90. Valve plate 48 which is coupled by pins 74 to shaft 12 likewise circularly rotates about axis 90 of shaft 15.

A leak channel 100 is provided through a small bore in output shaft 12. This channel prevents pressure buildup in the universal joint between the dog-bone shaft 15 and the inner bore 12' in shaft 12. The leakage fluid is passed to the low pressure output port 105, shown in FIG. 2.

A check ball system 26 in combination with fluid passages 25, 46 and 24, is provided to maintain seal 38 at the lower of the two part pressures for increased seal lift.

Access to internal components is achieved by removal of bolts 36. Removal of bolts allows all components to be disassembled. Between each housing component are seals 40 which prevent hydraulic fluid leakage from the motor. Seal 38 prevents fluid leakage forward of sleeve bearing 20 and plug 45 prevents fluid leakage aft of the motor. The seals are maintained in position by a close tolerance fit and internal motor pressure during motor operation. Dust cover 42 prevents foreign matter from entering into the internal workings of the motor.

During motor operation, high pressure fluid enters the hydraulic motor through inlet port 50. An inlet gallery 47, at the base of the inlet port 50, permits fluid to be conducted to eight inlet commutator ports (one of which is shown at 54 in FIG. 1) in the commutator 16. The inlet gallery 47 forms an open annulus in the commutator connecting all the high pressure commutator ports 54 and equalizing fluid pressure among them.

High pressure fluid from ports 54 flows through ports 56 in the valve plate 48 at appropriately synchronized intervals, as will be described in detail in connection with FIGS. 2 and 3. The valve plate 48 and ports 56 are shown in detail in FIG. 3 by solid lines. Commutator input ports 54 and output ports 49 are shown in dotted lines. As will be explained in connection with FIGS. 4, 5 and 6, the valve plate ports 56 sequentially allow fluid from the commutator ports 54 and 49 to enter and exit the chambers formed between the orbiting inner member 30 and non-rotating outer member 32. As may be seen in FIG. 3, the bore 80 in valve plate 48 is of sufficient diameter to permit shaft 15 to pass through with adequate clearance therebetween.

Figure 2:
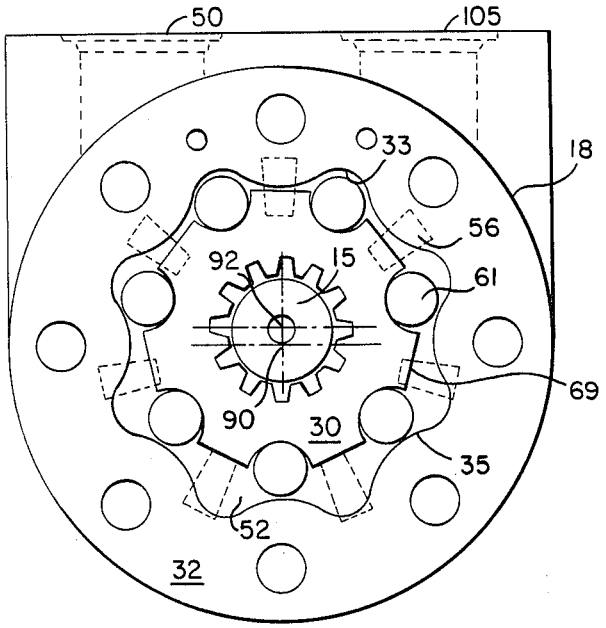
FIG. 2 is a further cross-section of the embodiment of FIG. 1 taken along lines 2—2 of FIG. 1 showing the inner and outer gear members 30 and 32, respectively.
Figure 3:
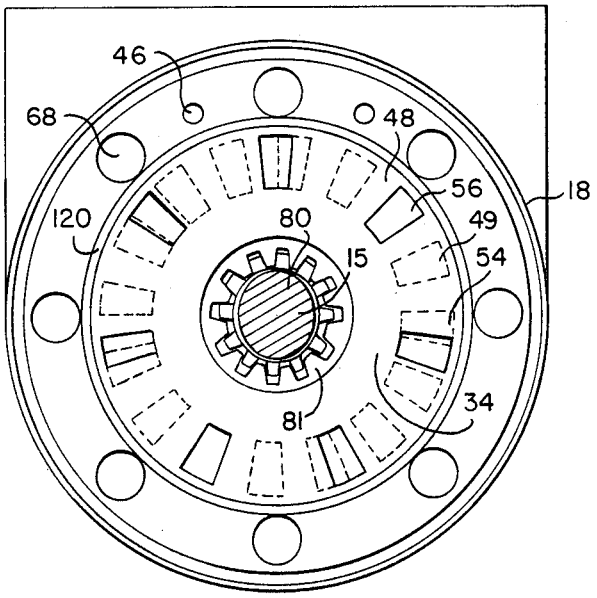
FIG. 3 is a cross-section taken along lines 3—3 of FIG. 1 showing the relationship of the valve plate 34 and the commutator ports 56 and 49.

As shown in FIG. 2, the inner member 30 is splined to accept shaft 15 and is provided with seven circumferentially spaced semicircular gear teeth 61 consisting of circular cylinders or rollers which are held at a uniform radius from the orbital center 92 of inner member 30. The gear teeth 61 are spaced equidistantly about the circumference of the inner member and are connected by flat portions 69. As indicated earlier, these flat portions are never active in an IGG-type gear set in that they do not need to contact the internal gears of outer member 32 for fluid sealing purposes.

The outer member has a non-circular or generated inner surface 33 with teeth or lobes 35 numbering one greater (8) than the number of teeth (7) on the inner member 30. The internally generated outer member's inner profile has a continuously changing radius of curvature which forms a smooth bearing surface for the teeth or tips 61 of the inner member.

The outer member 32 is fixed within the housing 18 and is concentric with the fixed inner shaft axis 90. Inner member 30 orbits about the center axis 90 and rotates about its own movable axis 92. The radius of the circle made by the inner gear's movable axis 92 in its movement about axis 90 defines the amount of the eccentric movement.

Figure 4:
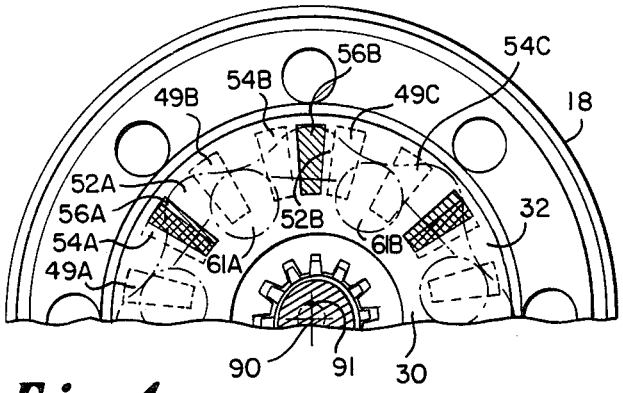
FIGS. 4, 5 and 6 are partial sections of the hydraulic motor of FIG. 1 showing the working relationship of the gear set commutator and valve combination at various moments of time during the clockwise orbital rotation of the inner member about the fixed access of the non-rotating outer member.
Figure 5:
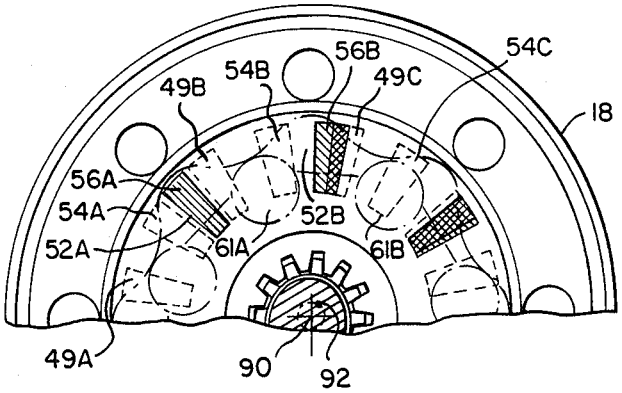
Figure 6:
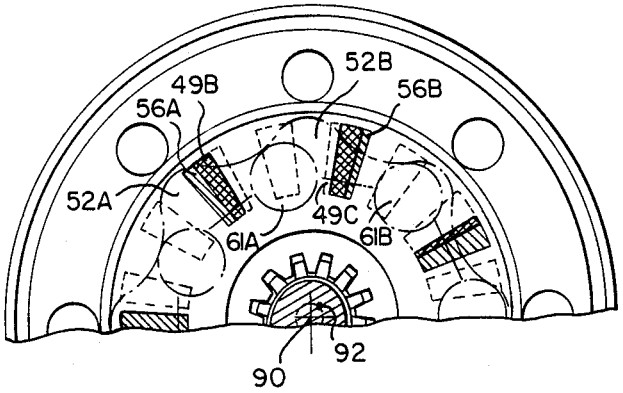

FIGS. 4, 5 and 6 shows the overlay relationship of the gear sets 30 and 32, the valve plate ports 56 and the commutator ports 54 and 49 as the motor operates. FIGS. 4, 5 and 6 are semi-schematic representations in which the motor is shown operating in a clockwise direction. The gear set 30 and 32 is shown in phantom and the commutator ports 54 and 49 in dotted lines. The valve plate ports 56 are shown in solid lines with shading. The crosshatching in FIGS. 4–6 denotes a condition wherein the valve plate port 56 overlaps one of the commutating ports 49 or 56.

In FIG. 4, chamber 52A is shown to be increasing in size and is being filled with high pressure fluid from commutator port 54A through valve port 56A which are in partial overlapping relation. Chamber 52B is at its maximum volume and is not in communication with either commutator port 54B or 49C, since valve port 56B is centered in the chamber 52B and between the two ports 54B and 49C.

FIG. 5 shows the same elements as in FIG. 4 after the inner member 30 has orbitally rotated a small fraction of a turn from the position shown in FIG. 4. The outer member's axis 90 has stayed fixed and the inner member's axis 92 has orbited about the inner member's axis 90. The valve plate 48, which is affixed to the output shaft and rotates about axis 90, has moved ports 56 to the position shown in FIG. 5. As a consequence, when chamber 52A has reached a maximum dimension, it is now sealed, i.e., out of fluid communication with the commutator ports 54A and 49B, due to the rotation of the valve port 56A. Note also, chamber 52B has begun to decrease in size, and the rotation of valve plate 48 has allowed lower pressure fluid to be withdrawn from the chamber 52B through valve port 56B, through the partial overlap with commutator port 49C, as indicated by the crosshatching.

FIG. 6 shows a further progression of the motor as chambers 52A and 52B both become smaller and have their low pressure fluid withdrawn through valve ports 56A and 56B overlapping with commutator ports 49B and C.

In all cases when a maximum chamber size is reached in the movement of the inner and outer members 30 and 32, the ports 56 in valve plate 48 do not open that chamber to the low pressure commutator ports 49 until most of the low pressure fluid has departed. High pressure and low pressure fluid is thereby fed and released from chambers 52 between the inner member 30 and the outer member 32 in an appropriately synchronized fashion.

In summary, in a motor mode of operation, high pressure fluid entering into the gear set chambers pushes the teeth formed by rollers 61 on the inner member 30 towards the low pressure areas as the chambers 52 become larger in response to high pressure. This use of fluid pressure to supply rotational energy decreases the hydrostatic pressure of the fluid. Low pressure fluid is then withdrawn from the chambers 52 between the outer and inner members back through the ports 56 in valve plate 48 when they overlap the low pressure commutator ports 49. To reverse rotation of the motor, high pressure and low pressure fluid may be reversed at the inlet and outlet, and the motor will work as efficiently in the opposite direction from that detailed above.

The seven valve ports 56 on the valve plate 48 operate eight times per revolution of output shaft 12 to allow pressure to enter and leave the chambers 52. This continual release of fluid pressure for rotational energy in each of the seven chambers 52 provides high torque for a small amount of rotation. Given a similar fluid input pressure, a traditional gerotor set with only two valve ports would have to rotate at a much faster speed to supply equivalent torque. It is for this reason that the motor 10 is considered a high torque low speed motor.

EQUIVALENTS

While the invention has been particularly shown and described with reference to preferred embodiments thereof, it will be understood by those skilled in the art that various changes in form and details may be made therein without departing from the spirit and scope of the invention as described in the appended claims. For example, while the invention has been described in a motor mode of operation, it is contemplated that it may be useful in pump applications. The teeth on the inner member may be non-geroler fixed teeth in low cost, less efficient applications.

I claim:

1. A hydraulic motor device comprising:

(a) a valve plate having a first and second planar face and rotatable about a central fixed axis, said valve plate having a plurality of control ports extending between the faces;

(b) a commutator having a plurality of alternate fluid inlet ports and fluid outlet ports, each facing the second planar face of the valve plate and adapted for fluid communication with the control ports on said rotary valve plate;

(c) a fluid displacement set adjacent the first face of the valve plate and having an inner gear member with external gear teeth which orbits about said fixed central axis and rotates about its own movable axis which is displaced from the fixed axis and a stationary outer gear member with internal gear teeth disposed concentric to said fixed axis and inactive portions provided between the external gear teeth of the inner gear member which inactive portions are not in contact with the internal gear teeth of the outer gear member during revolution of the inner gear member;

(d) variable volume chambers formed between the inner and outer members which are in direct fluid communication with the control ports on said valve plate; and (e) an output shaft affixed to said rotary valve plate and driven to rotate about said fixed axis by said inner member to which it is connected by a universal coupling device.

2. The motor of claim 1 in which the outer gear member has a generated continuous curved inner peripheral contour forming $N+1$ teeth which contact N opposing external teeth on said inner gear member to form said chambers.

3. The motor of claim 2 wherein $N=7$.

4. A hydraulic rotary fluid displacing device comprising:

(a) a first shaft adapted to rotate about a fixed central axis;

(b) a fluid displacing gear set inlcuding:

(i) an inner member having external gear teeth which orbits about the fixed central axis and rotates about its own movable axis;

(ii) a stationary outer member concentric to the fixed central axis and having internal gear teeth which form variable volume chambers with corresponding external gear teeth on said inner member and wherein portions of the external periphery of said inner member between said external gear teeth are not in contact with the internal periphery of said outer member during revolution of said gear set;

(c) a second shaft rotatably coupled at a first end to said inner member and rotatably coupled at a second end to said first shaft, (d) a rotating valve plate having a number of ports equal to the number of external gear teeth on the inner member and extending through first and second planar faces of said valve plate and attached to said first shaft adjacent to said inner and outer members, a first face of said valve plate being in fluid sealing relationship with a face of said inner and outer members for controlling fluid communication to and from said variable volume chambers and (e) a stationary commutator having a central bore disposed around the second end of the second shaft and having N+1 inlet ports and N+1 outlet ports wherein N corresponds to the number of external gear teeth on the inner member, said ports being disposed adjacent the second face of said valve plate.

5. The device of claim 1 wherein said second shaft provides a universal coupling between said inner member and said outer member.

6. The device of claim 1 wherein the contour of the external gear teeth of the inner member is a smooth continuous generated curved.

7. A rotary fluid displacing apparatus operable as pump or motor comprising:

(a) housing means;

(b) a fluid displacing unit within said housing means and comprising an outer annular member stationarily mounted in said housing means and having a plurality of inwardly extending teeth and an inner member within said outer member and having radially outwardly extending teeth numbering one tooth less than those of outer member and meshing with said teeth of the latter, said inner member being provided with a central opening therethrough and with non-sealing portions between the outwardly extending teeth of the inner member;

(c) a machine shaft mounted in said housing means for rotation about a fixed axis and having an end portion projecting beyond said housing means and an opposite tubular end portion having a central bore with radially inwardly projecting teeth;

(d) a universal-joint shaft connected at opposite ends respectively to said machine shaft and said inner member for rotation therewith in tiltable relation thereto;

(e) a stationary commutator and a rotary valve plate both formed with central openings therethrough, said universal joint shaft extending through the central opening in said rotary valve plate, said commutator having N+1 input ports and N+1 output ports alternately disposed about a face of said commutator adjacent a first face of said valve plate; said rotary valve plate having N ports extending from the first face of the valve plate to the second face of the valve plate and wherein the second face of the valve plate is adjacent to and in fluid sealing relationship with the variable volume chambers and N corresponds to the number of teeth on the inner member;

(f) said central opening in said inner member being provided with radially inwardly projecting teeth and said universal joint shaft being provided with two sets of radially outwardly extending gear teeth curved in axial direction and respectively meshing with said teeth at said central bore of said machine shaft and said teeth at said central opening of said inner member;

(g) said machine shaft and said rotary valve plate being rotatably coupled together for rotation about said fixed axis.

8. The apparatus of claim 7 in which the valve plate is coupled to the machine shaft by affixing the valve plate to the tubular end portion of the machine shaft containing said central bore.

9. The apparatus of claim 7 in which the inner member orbits about said fixed axis and rotates about its own axis which is displaced from said fixed axis.

10. The apparatus of claim 7 in which the non-sealing portions are provided in the outer periphery of said inner member intermediate the outwardly extending teeth.

* * * * *